US007619375B2

(12) United States Patent
Zumoto et al.

(10) Patent No.: US 7,619,375 B2
(45) Date of Patent: Nov. 17, 2009

(54) ELECTROMAGNETIC WAVE GENERATING DEVICE

(75) Inventors: Nobuyuki Zumoto, Tokyo (JP); Takahisa Nagayama, Tokyo (JP); Kazushi Hanakawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 581 days.

(21) Appl. No.: 11/541,679

(22) Filed: Oct. 3, 2006

(65) Prior Publication Data

US 2007/0182498 A1 Aug. 9, 2007

(30) Foreign Application Priority Data

Feb. 6, 2006 (JP) ..... 2006-028270

(51) Int. Cl.
*H05H 11/00* (2006.01)

(52) U.S. Cl. ..... 315/504; 315/500; 315/507

(58) Field of Classification Search ..... 315/500, 315/501, 502, 504, 506, 507
See application file for complete search history.

(56) References Cited

U.S. PATENT DOCUMENTS 2,447,255 A * 8/1948 Kerst et al. ..... 315/502
2,572,551 A * 10/1951 Wideroe ..... 315/504
2,675,470 A * 4/1954 Wideroe ..... 315/504
2,754,419 A * 7/1956 Wideroe ..... 315/501
6,713,976 B1 * 3/2004 Zumoto et al. ..... 315/500

OTHER PUBLICATIONS

Hiroo Kumagai, "Betatron Accelerator", Experimental Physics Lecture, Dec. 25, 1975, vol. 28, pp. 547-563, published by Kyoritsu Shuppan Co., Ltd., ISBN: 4-320-03083-4.

* cited by examiner

*Primary Examiner*—Douglas W Owens
*Assistant Examiner*—Ephrem Alemu
(74) *Attorney, Agent, or Firm*—Buchanan Ingersoll & Rooney PC

(57) ABSTRACT

An electromagnetic wave generating device includes: a hollow annular vacuum chamber; an electron gun; an electromagnet configured with a pair of discoid combinations in which a cylindrical accelerating magnet pole and an annular focusing magnet pole are arranged in this order from the inner side to the outer side of the combinations, and are disposed symmetrically and concentrically with each other on both sides of the chamber and coaxially with the center axis of the chamber, and a return yoke disposed outside both accelerating and focusing magnet poles and the chamber; accelerating coils wound around the accelerating magnet poles, for exciting the poles; and focusing coils wound around the focusing magnet poles, for exciting the poles; wherein a through hole is formed at the center of the accelerating magnet pole so that power supply wires connecting the accelerating coils to an accelerating power supply are led out through the hole.

5 Claims, 11 Drawing Sheets

ELECTROMAGNETIC WAVE GENERATING DEVICE

BACKGROUND OF THE INVENTION

1. Field of the Invention

The present invention relates to an electromagnetic wave generating devices for generating an electromagnetic wave such as an X-ray by electrons revolving in a circular orbit inside an accelerator 2. Description of the Prior Art As conventional electromagnetic wave generating devices using annular accelerators, there have been devices that make use of an accelerator employing the principle of betatron acceleration (hereinafter refers to as "betatron accelerator") Refer to Experimental Physics Lecture, Vol. 28 "Accelerator", § 13 "Betatron", pp. 547-563, edited by Kumagai Hiroo, published by KYORITSU SHUPPAN CO., LTD., Dec. 25 1975, ISBN: 4-320-03083-4 (Non-Patent Document).

A betatron accelerator is provided with an electromagnet to an accelerate electron beam emitted into a vacuum chamber by the magnetic field generated with alternating current flowing in exciting coils attached to the electromagnet. The accelerated electron beam impacts upon a metal target to emit an X-ray, which radiates outward from electromagnetic wave generating devices. The electromagnet has magnet pole portions and yoke portions to form magnetic circuits generated by the exciting coils. There have been varieties of the accelerators according to arrangements and combinations of the exciting coils, the magnet poles, and the yokes.

A conventional electromagnetic wave generating device using the betatron accelerator, for example, is configured with both magnet poles for focusing the electron beam and magnet poles for accelerating the electron beam on a common return yoke, or configured by combining the focusing magnet poles with the accelerating magnet poles each of which have been fabricated individually (e.g., refer to FIG. 13.2, p. 549 of the prior art). While, in this case, a focusing coil for exciting the focusing magnet poles and an accelerating coil for exciting the accelerating magnet poles may be used in common with each other, in cases where both incident electron beam and the X-ray emission need to be precisely controlled, respective electric power supplies for the focusing and accelerating coils are used independently.

Since the conventional electromagnetic wave generating device is so configured as described above, when the focusing and accelerating coils are provided independently in order to control the incident beam and the X-ray emission precisely, there have been problems as follows.

In cases of employing the common return yoke, the accelerating coil must be placed inside the focusing coil, which involves the accelerating coil to be placed inside a vacuum chamber, the power supply wires to the accelerating coil have no other choice but to be passed through between the vacuum chamber and the focusing magnet poles. Consequently, there have been problems in that reduction in the vacuum chamber volume causes electron beam loss to increase, or increase in the gap between the focusing magnet poles causes the focusing coil power supply and the electromagnet to increase in capacity and size, respectively.

Moreover, when the focusing and accelerating magnet poles are fully independent of each other, there has been a problem in that the accelerating magnet poles have to be made larger so that the electromagnetic wave generating device itself becomes bulky.

SUMMARY OF THE INVENTION

The present invention has been made to resolve above described problems, and to realize an electromagnetic wave generating device that is smaller in size and can use also a smaller capacity power supply than conventional ones.

An electromagnetic wave generating device according to the present invention includes: a hollow annular vacuum chamber having a rectangular cross section, whose interior is tightly sealed to be kept under vacuum; an electron gun for emitting an electron beam into the vacuum chamber; an electromagnet configured with a pair of discoid combinations in which a cylindrical accelerating magnet pole and an annular focusing magnet pole with a rectangular cross section are arranged concentrically in this order from the inner side to the outer side of the discoid combinations, and the discoid combinations are disposed symmetrically with each other on both sides of the vacuum chamber and the center axis of each discoid combination is made coaxial with that of the chamber, and a return yoke that is disposed outside around both accelerating and focusing magnet poles and the chamber; accelerating coils that are wound around the accelerating magnet poles, for exciting the accelerating poles; and focusing coils that are wound around the focusing magnet poles, for exciting the focusing poles, wherein a through hole is formed at the center of the accelerating magnet pole so that power supply wires that connect the accelerating coils to an accelerating power supply for supplying electric power to the accelerating coils are led out through the hole.

Other objects and aspects of the present invention will become more apparent from the following description of embodiments with reference to the accompanying drawings.

DETAIL DESCRIPTION OF THE PREFERRED EMBODIMENTS

Embodiment 1

Figure 1:
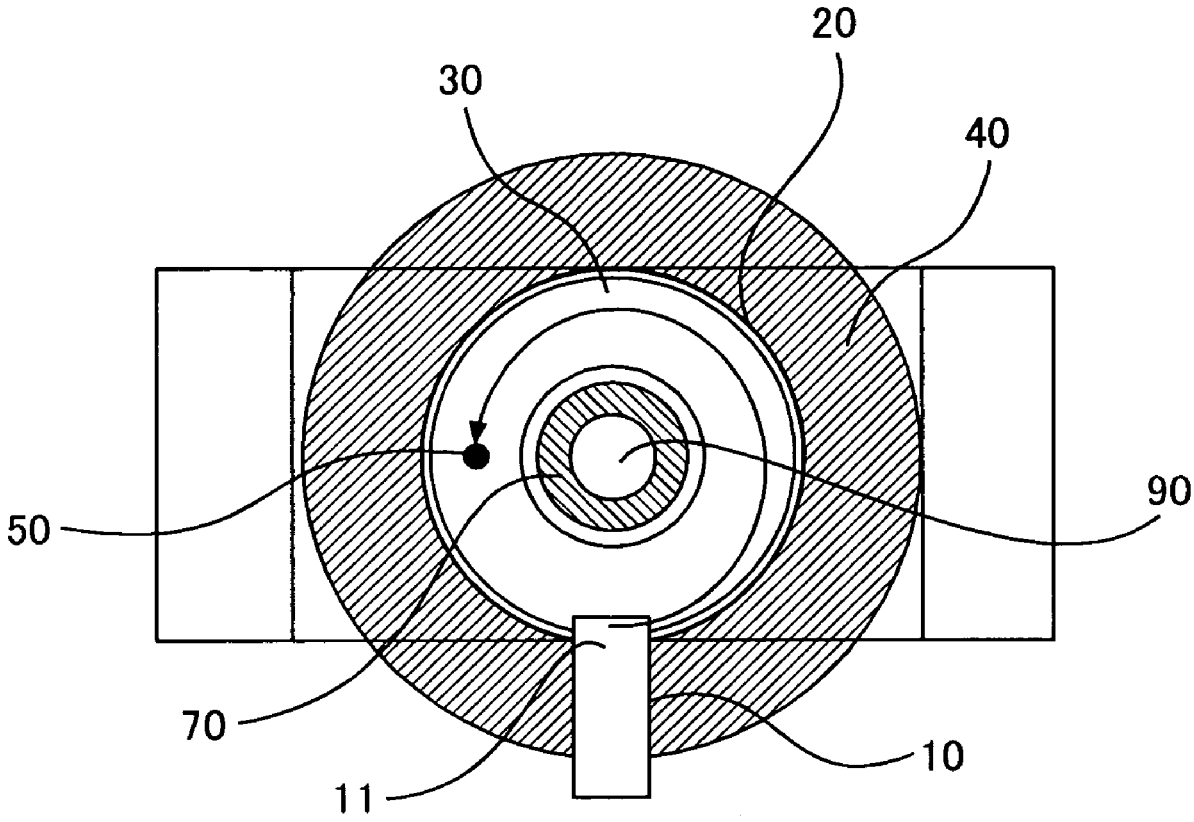
FIG. 1 is a horizontal sectional view illustrating an electromagnetic wave generating device according to Embodiment 1 of the invention.
Figure 2:
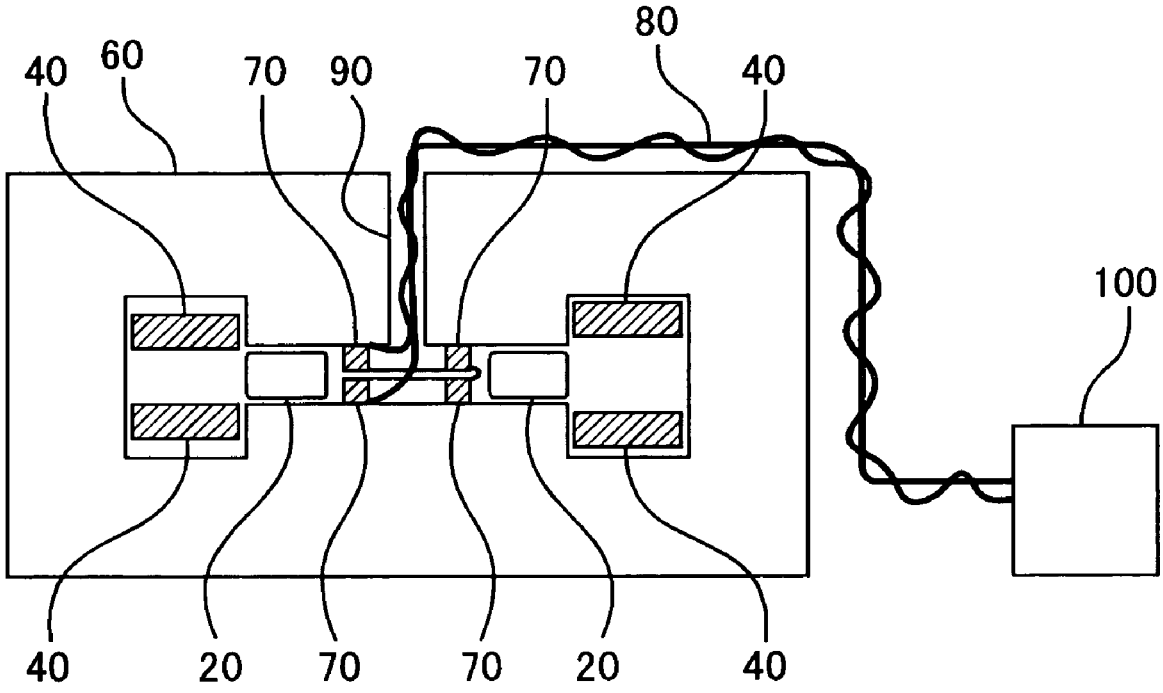
FIG. 2 is a vertical sectional view illustrating the electromagnetic wave generating device according to Embodiment 1 of the present invention.

FIG. 1 and FIG. 2 illustrate an electromagnetic wave generating device according to Embodiment 1 of the present invention, and FIG. 1 is a horizontal sectional view and FIG. 2 is a vertical sectional view.

Referring to FIG. 1, an electron emitting portion 11 of an electron gun 10 is disposed inside a vacuum chamber 20, for emitting an electron beam 30 from the electron emitting 11 into the vacuum chamber 20. The emitted electron beam 30 revolves in a circular orbit indicated in FIG. 1, by focusing magnetic flux generated by focusing coils 40, and impacts a target 50 to emit an electromagnetic wave.

The vacuum chamber 20 has a hollow annular structure, and the inside thereof is maintained under high vacuum so that the electron beam 30 revolves cyclically in the circular orbit. The cross section of the chamber 20 is formed in a rectangular shape elongated radially to make allowance for some fluctuations in the orbital radius of the electron beam 30.

Figure 3:
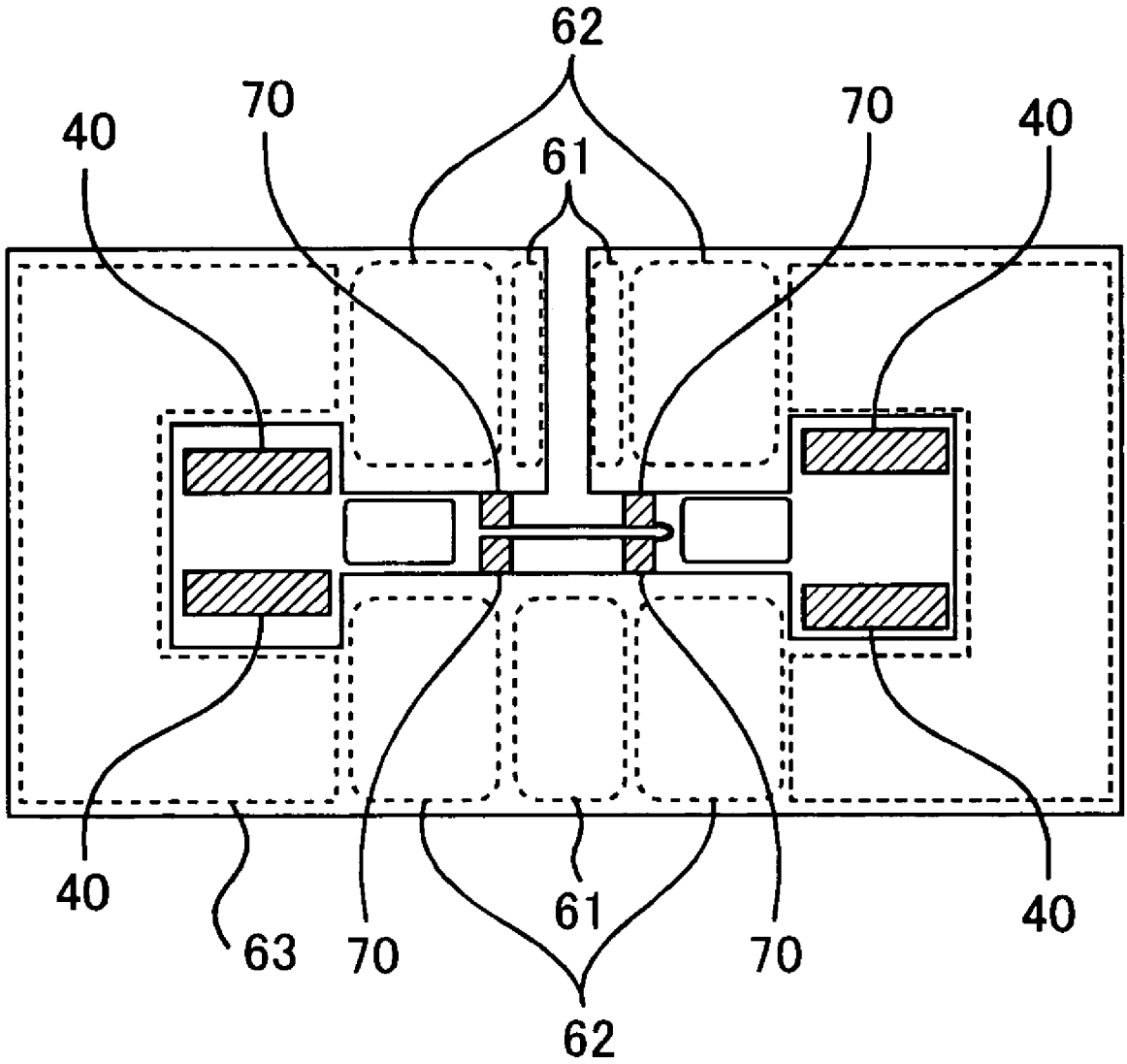
FIG. 3 is a configurational view illustrating magnet poles of the electromagnetic wave generating device according to Embodiment 1 of the invention.

An electromagnet 60 may be divided into three portions according to functions of the inner magnetic flux as shown in FIG. 3, that is, accelerating magnet poles 61, focusing magnet poles 62, and return yokes 63.

The accelerating magnet poles 61, which are excited by both accelerating coils 70 and focusing coils 40, form cylindrical portions where their generated magnetic flux mainly serves to accelerate the electron beam 30. The focusing magnet poles 62, which are excited only by the focusing coils 40, form annular portions with a rectangular cross section where the magnetic flux serves to keep the revolving orbit of the electron beam 30 and to focus the beam 30. The accelerating magnet poles 61 and the focusing magnet poles 62 are incorporated in a pair of discoid combinations in which they are arranged concentrically in this order from the inner side to the outer side thereof, and are disposed symmetrically with each other on both side of the vacuum chamber and the center axis of the each discoid combination is made coaxial with that of the chamber. The return yokes 63, which are disposed outside the magnet poles 61 and 62, and the chamber 20, provide a magnetic flux return paths across the accelerating magnet poles 61 and across the focusing magnet poles 62.

The accelerating coils 70 are interposed between the accelerating magnet poles 61 to generate an accelerating magnetic flux that is independent of the electron beam 30 orbit. Since a leakage magnetic flux, however, may have an effect on the electron beam 30 orbit, the coils 70 are divided into two parts that are symmetrical with respect to the horizontal center plane and disposed as shown in FIG. 2 so as to avoid the effect being asymmetrical. These two coils are connected in series with each other, and each end thereof is connected to an accelerating power supply 100 disposed outside the electromagnet 60 using twisted power supply wires 80 through a through hole 90.

While in FIG. 3, the gap between the accelerating poles 61 is the same as that between the focusing poles 62, these gaps generally should be determined to be different from each other based on the optimal design. Moreover, the diameter of the through hole 90 is also determined, based on magnetic field calculation, to be minimum so as not to disturb the surrounding magnetic field as possible.

It is noted that the electron gun 10 is attached with an electron gun power supply, etc.; a vacuum chamber 20 is attached with the vacuum pump, etc.; and the focusing coils 40 are attached with a focusing power supply, etc., for exciting the coils; they are not shown in the figures.

While Embodiment 1 shows the configuration in which the gaps between the pair of the accelerating magnet poles 61 and between that of the focusing magnet poles 62, poles of each pair are disposed symmetrically with respect to the horizontal center plane, are minimum, the distances of these gaps between each pair of the magnet poles affect the size of the electromagnet 60 as well as the capacities of the accelerating power supply 100 and the focusing power supply as explained below.

As for exciting current I [A], a distance of the gap g [m], and magnetic flux density B [T], the following relationship given by Eq. 1 is held at each gap center:

$$I=\{g/(\mu_0*N)\}*B \qquad \text{Eq. 1,}$$

where $\mu_0$ is the vacuum permeability and N is the number of turns in coil.

From Eq. 1, the exciting currents are necessarily proportional to the gaps between each pair of the magnet poles, respectively. Therefore, increasing the gaps between each pair of the magnet poles brings the power supplies to increase in capacity accordingly.

Furthermore, the increase of the gaps between each pair of the magnet poles brings the heat generation W in the coils to increase as given by following Eq. 2:

$$W=R*I^2=L*\rho*B^2*g^2/(\mu_0^2*S) \qquad \text{Eq. 2,}$$

where L is a coil perimeter, ρ is the electric resistivity of coil material, and S is the cross sectional area of a coil, which denotes the total cross sectional areas of the core wires in the cross section of the coil.

Ordinarily, electromagnets used in this sort of accelerators are designed, by reason of miniaturization, with a least margin against the heat generation, so that the cooling ability for each coil is limited. Accordingly, increasing the cross sectional areas of the coils is a way to deal with the increase of the heat generation, which brings, however, the electromagnet 60 to become bulky.

As explained above, the size of the electromagnet 60 as well as the capacities of both the accelerating power supply 100 and the focusing power supply can be reduced by narrowing the gaps between each pair of the accelerating magnet poles 61 and the focusing magnet poles 62.

Figure 5:
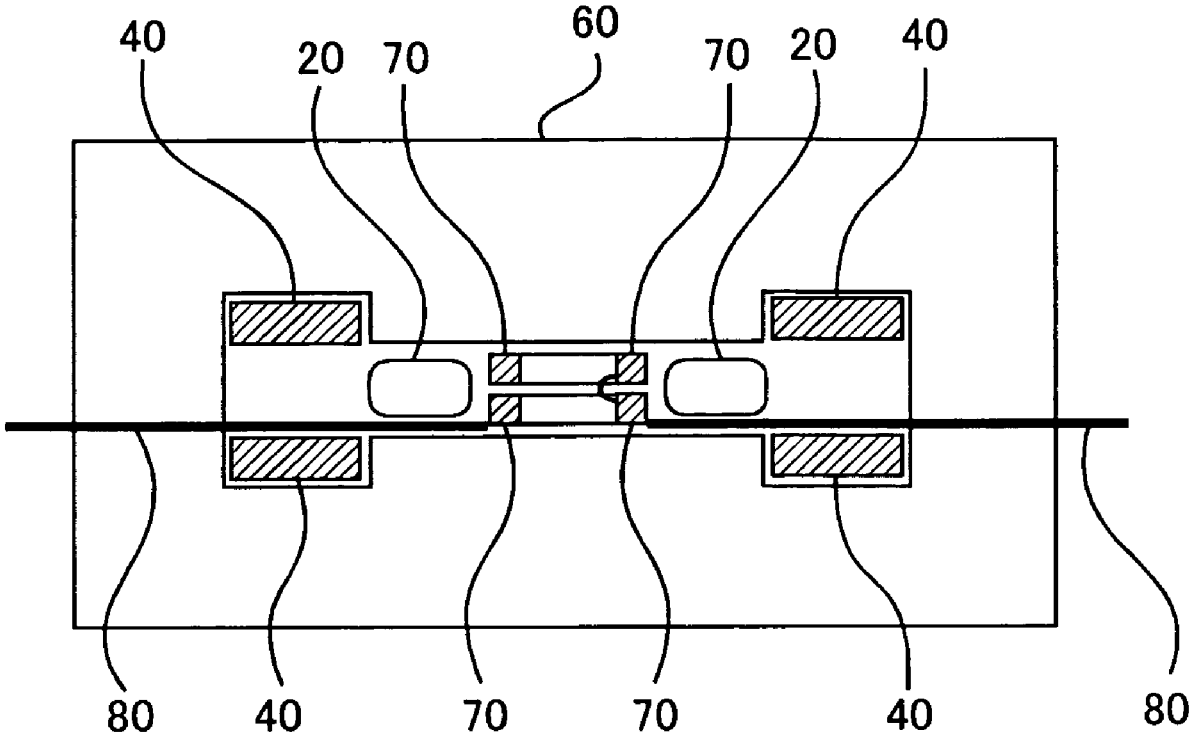
FIG. 5 is an explanatory view illustrating another way to lead out the power supply wires of accelerating coils not according to the invention.

In Embodiment 1, the through hole 90 is formed at the center of the electromagnet 60 in order that the power supply wires 80 of the accelerating coils 70 are led out as shown in FIG. 2. If the wires 80, for example, are led out without forming the through hole 90, the gap between the focusing magnet poles 62 necessarily becomes larger by at least the thickness of the wire 80 due to interference of the wire 80 with the vacuum chamber 20, as shown in FIG. 5.

Figure 4:
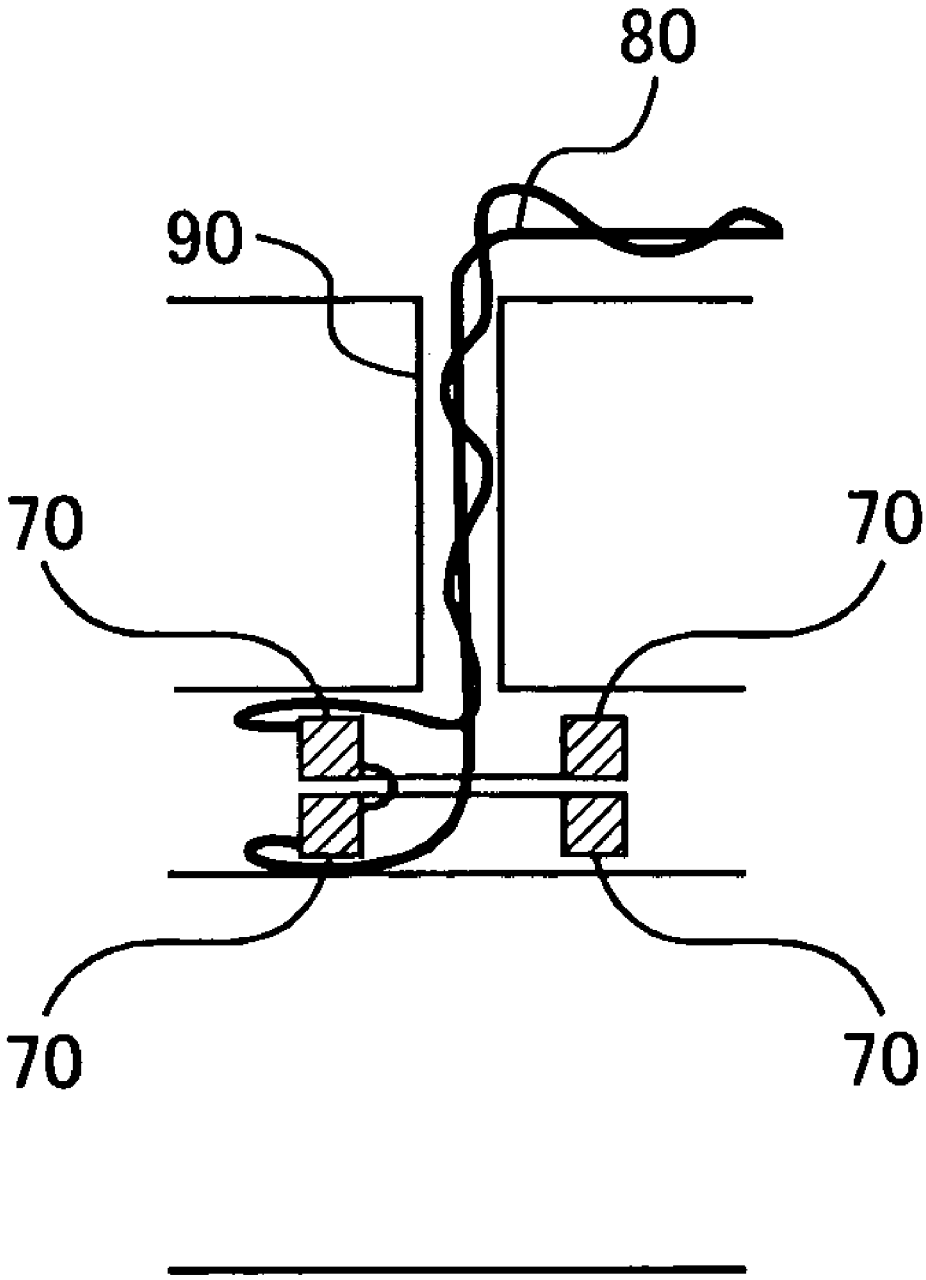
FIG. 4 is an explanatory view illustrating a way to lead out the power supply wires of accelerating coils not according to the invention.

Moreover, in Embodiment 1, one of the accelerating coils 70, originating from the power supply wire 80, is wound from the inner side to the outer side thereof, and the other of the coils 70, originating from the outermost wire of the one of the coils 70, is wound from the outer side to the inner side thereof. Such windings allow respective ends of the power supply wires 80 to be led out from the innermost side of the coils 70. On the contrary, if the power supply wires 80 are led out, through the through hole 90, from the outermost side of the coils 70, the power supply wires 80 is inevitably passed astride the accelerating coils 70 as shown in FIG. 4, which requires the gap between the accelerating magnet poles 61 to be larger.

Even though the through hole 90 is formed outside the accelerating coils 70 instead of the center of the electromagnet 60, the power supply wires 80 may be led out without interference with the accelerating coils 70 and the vacuum chamber 20. In this case, however, the electron beam 30 orbit necessarily comes close to the through hole 90, which brings a design problem with the electromagnet 60. Conversely, leading out the power supply wires 80 from the center the electromagnet 60 brings about effects to enhance accuracy of the magnetic flux by the electromagnet 60.

As explained above, the accelerating coils 70 are wound in such a way that the power supply wires 80 are led out from the inner side of the coils 70 through the through hole 90 formed at the center of electromagnet 60, so that the gaps between each pair of the magnet poles can be narrowed.

Assuming that a small accelerator has a vacuum chamber 20 of, for example, 100 mm outer diameter and 20 mm height, the gaps between each pair of the accelerating magnet poles 61 and the focusing magnet poles 62 in the configuration of FIG. 5, are the total distance of the vacuum chamber 20 height and the power supply wire 80 thickness. Since the power supply wire 80 may have an approximately 2 mm thickness, taking into account the wire sheath, even if each wire of the power supply is led out in the right and the left directions, respectively, as shown in FIG. 5, the gaps between each pair of the magnet poles are required to be 22 mm.

In contrast, the configuration of the present invention allows the magnet poles to come close to each other up to the exact height of the vacuum chamber 20 as shown in FIG. 2, so that the gaps between each pair of the magnet poles can be set at 20 mm. Thus, from Eq. 1 for exciting current and Eq. 2 for coil cross sectional area, the exciting current as well as the size of the electromagnetic 60 can be reduced by 10% compared to the case with FIG. 5 not according to the present invention.

As described above, the reduction of the exciting current has brought the reduction, due to decrease in its electric power consumption, of the accelerating power supply 100 in production cost as well as in running costs. At the same time, the reduction of the electromagnet 60 in size has brought about effects in which not only the installation space for the electromagnetic wave generating device can be smaller, but also the production cost of the focusing power supply as well as its running costs, due to decrease of its electric power consumption, can be reduced.

Figure 6:
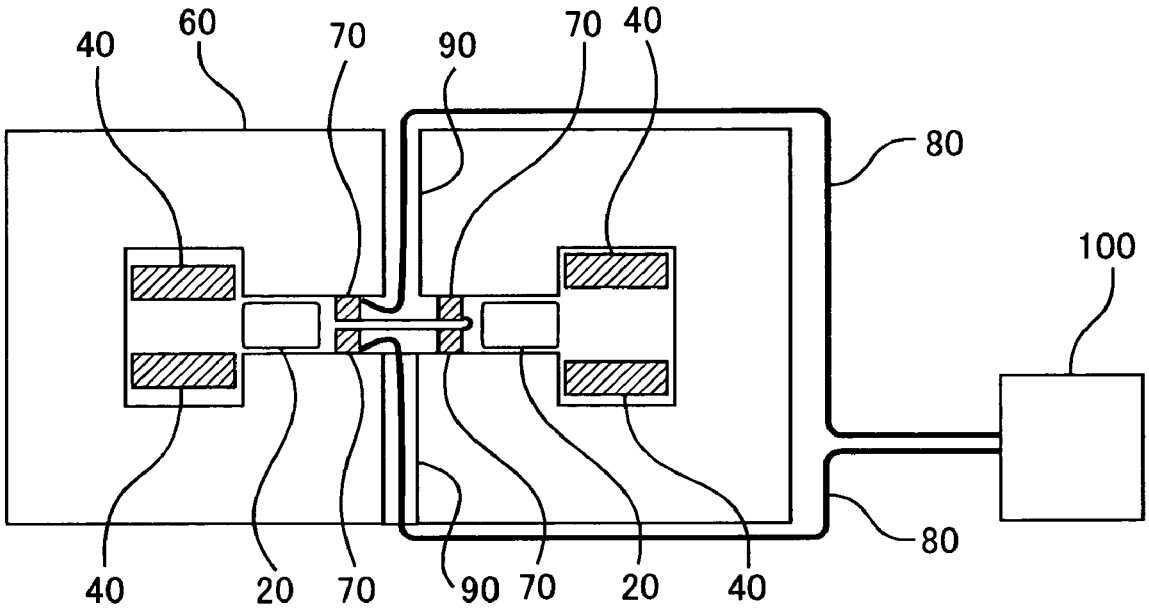
FIG. 6 is an explanatory view illustrating another way to lead out the power supply wires of accelerating coils not according to the invention.
Figure 7:
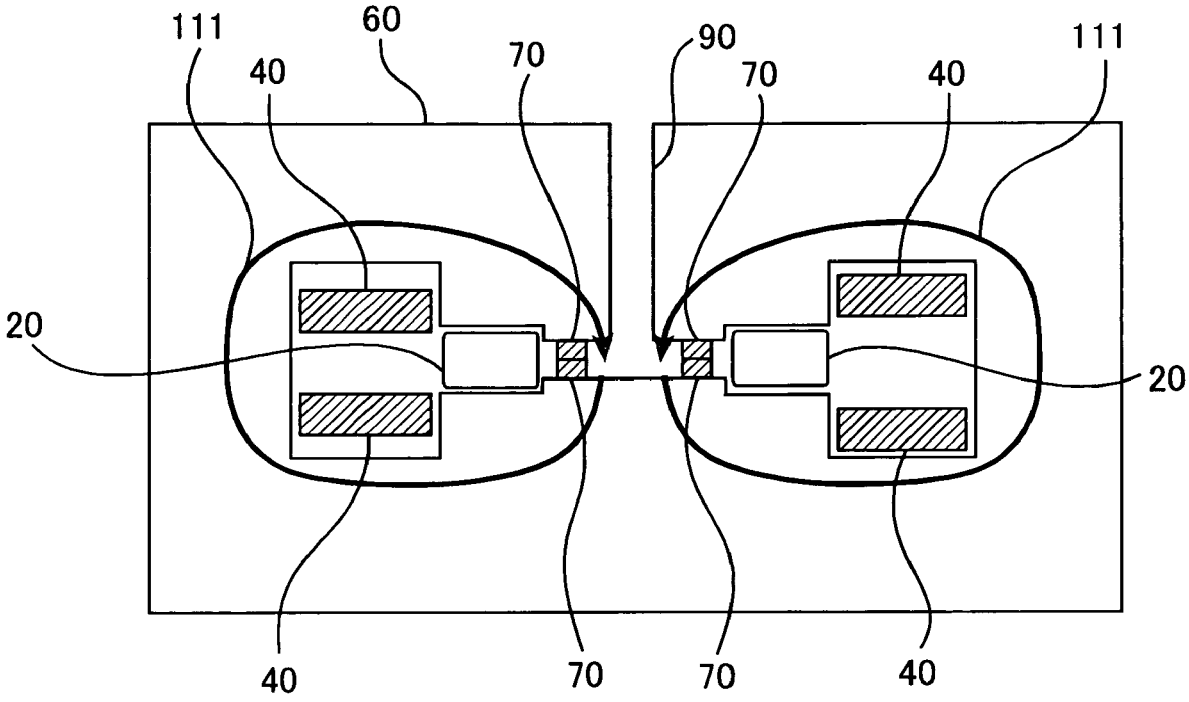
FIG. 7 is a view schematically illustrating magnetic flux according to Embodiment 1 of the invention.
Figure 8:
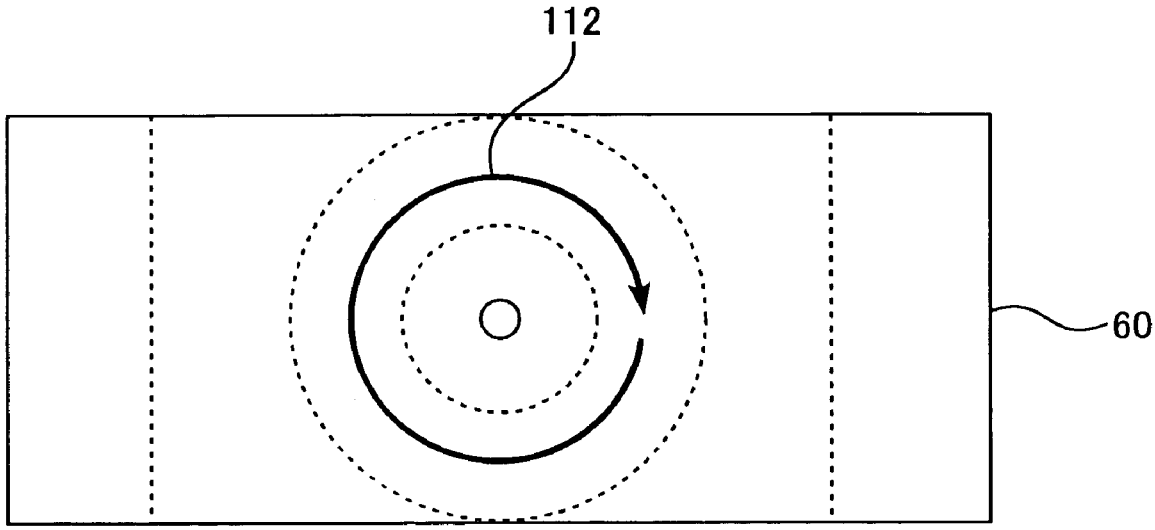
FIG. 8 is a view schematically illustrating magnetic flux generated by accelerating coils with the power supply wires led out not according to the invention.
Figure 9:
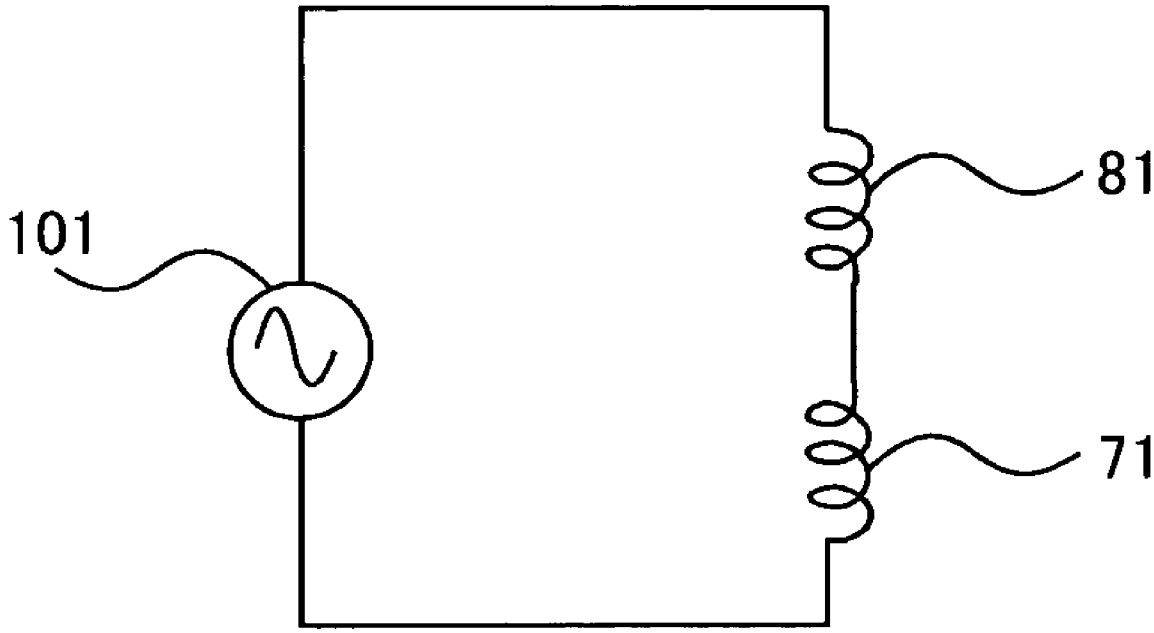
FIG. 9 is an equivalent circuit model showing the inductances of accelerating coils with the power supply wires pulled out not according to the invention.

In leading out the power supply wires 80 through the through hole 90 formed at the center of the electromagnet 60, if each wire 80 is led out in the two directions, respectively, i.e., upward and downward with respect to the electromagnet 60 as shown in FIG. 6, each power supply wire 80 is passed separately around the electromagnet 60, which generates magnetic flux (indicated by the numeral 112 in FIG. 8) orthogonal to the original magnetic flux (indicated by the numeral 111 in FIG. 7) to be generated by the electromagnet 60. Whereby, as shown with the equivalent circuit in FIG. 9, the inductance 81 of the power supply wires 80 is added to the inductance 71 indigenous to the accelerating coils 70, which increases the overall inductance from the perspective of the accelerating power supply 100, resulting in increase of the voltage required for the accelerating power supply 100.

Then, if the power supply wires 80 are led out together in one direction so as not to be passed around the electromagnet 60 as shown in FIG. 2, unnecessary inductance is not created in the power supply wires 80. The voltage of the accelerating power supply 100, therefore, can be lowered, which brings the reduction of the power supply 100 in cost.

It is noted that using the twisted-pair wires as the accelerating power supply wires 80 brings about effects to enhance resistance against fluctuations in the accelerating power supply 100 voltage caused by external magnetic flux.

Figure 10:
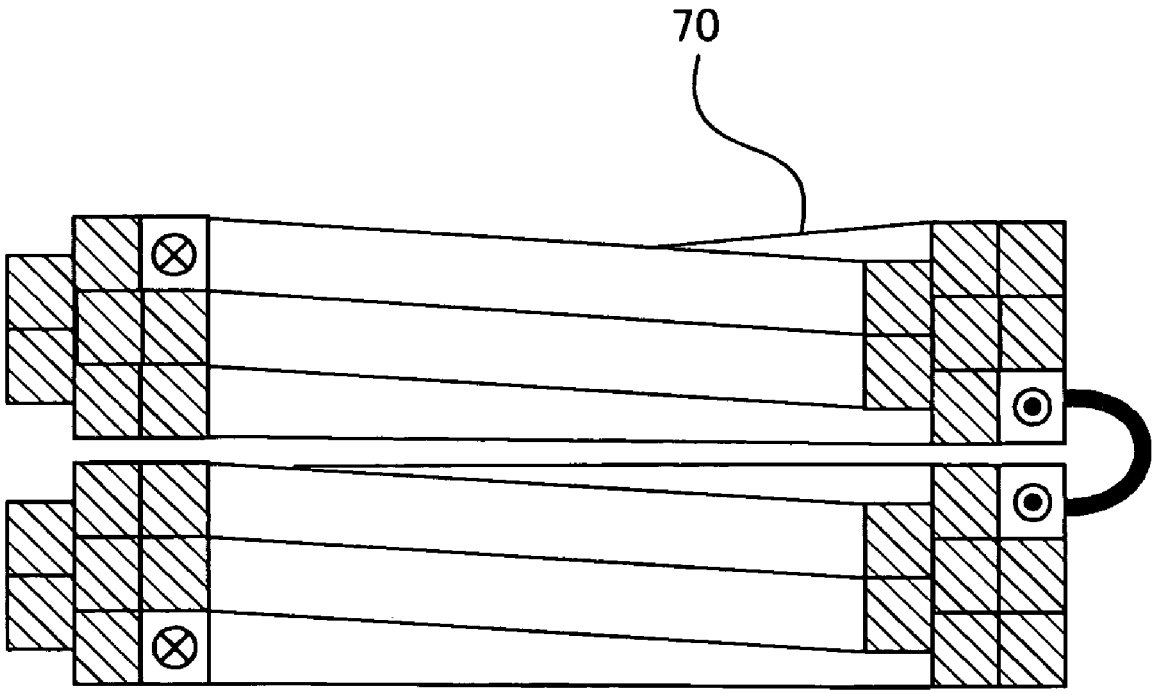
FIG. 10 is a cross sectional view of the accelerating coils in the electromagnetic wave generating device according to Embodiment 1 of the invention.

Moreover, the wire of the accelerating coils 70 is made rectangular in cross section as shown in FIG. 10 so that the coils 70 can be formed with no spaces between adjacent wires of the coils.

Figure 11:
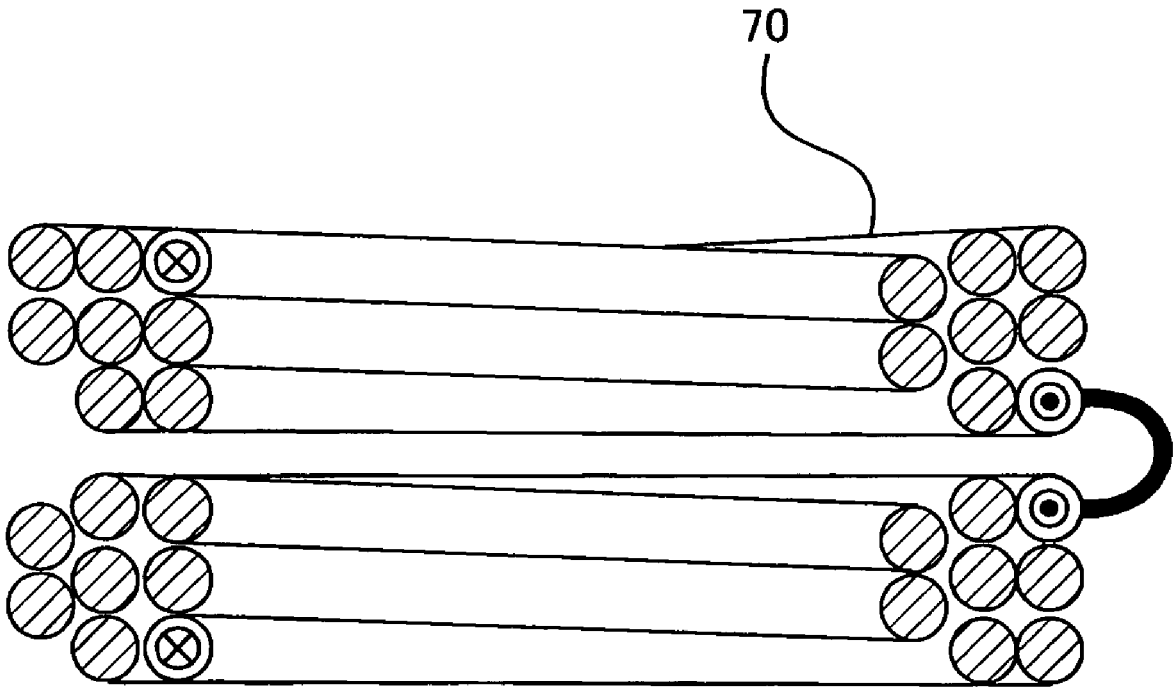
FIG. 11 is a cross sectional view of accelerating coils not according to the invention.

If a circular cross section wire is used as shown in FIG. 11, an installation area for the coil becomes larger to maintain a desired cross sectional area of the coil, so that the electromagnet necessarily increases in size. Using the coil with the rectangularly shaped wire, in contrast, makes the installation area for the coil be minimum to obtain a desired overall cross sectional area of the coil, so that the electromagnet 60 can be designed in a minimal size, which brings space-saving for an electromagnetic wave generating device, and the reduction in production cost of a power supply as well as running costs thereof.

What is claim is:

1. An electromagnetic wave generating device, comprising:

a hollow annular vacuum chamber, the chamber being hermetically sealed to be kept under vacuum;

an electron gun for emitting an electron beam into the vacuum chamber;

an electromagnet including: a pair of discoid combinations each composed of a cylindrical accelerating magnet pole and an annular focusing magnet pole with a rectangular cross section, arranged in this order from the inner side to the outer side of the discoid combination, and disposed concentrically and symmetrically with each other on both sides of the vacuum chamber, and the center axis of the each discoid combination being made coaxial with that of the chamber; and a return yoke disposed outside around both the accelerating and focusing magnet poles, and the vacuum chamber;

a pair of accelerating coils each wound around the accelerating magnet poles, for exciting the accelerating magnet poles;

a pair of focusing coils each wound around the focusing magnet poles, for exciting the focusing magnet poles;

a through hole formed along the center axis of the accelerating magnet poles; and power supply wires led out through the through hole, to be connected to an accelerating power supply, for supplying electric power to the accelerating coils.

2. The electromagnetic wave generating device according to claim 1, wherein the through hole is formed in either one of the pair of accelerating magnet poles, and lead-in and lead-out power supply wires are led out through the through hole in common with each other.

3. The electromagnetic wave generating device according to claim 1, wherein one of the accelerating coils is wound radially from the inner side to the outer side of the one of the coils and the other coil is wound radially from the outer side to the inner side thereof, and the outer ends of the windings of both accelerating coils are connected with each other, and the inner ends of the windings of the accelerating coils are connected to the power supply wires.

4. The electromagnetic wave generating device according to claim 1, wherein the accelerating coil is wound from a wire having a rectangular cross section.

5. The electromagnetic wave generating device according to claim 1, wherein lead-in and lead-out power supply wires are twisted-pair wires that are twisted around each other.

* * * * *